US006696794B2

(12) United States Patent
Ishizuka

(10) Patent No.: US 6,696,794 B2
(45) Date of Patent: Feb. 24, 2004

(54) METHOD FOR DRIVING AC PLASMA DISPLAY

(75) Inventor: Mitsuhiro Ishizuka, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/891,413

(22) Filed: Jun. 27, 2001

(65) Prior Publication Data

US 2002/0050794 A1 May 2, 2002

(30) Foreign Application Priority Data

Jun. 28, 2000 (JP) ..... 2000-195224

(51) Int. Cl.[7] ..... G09G 3/10
(52) U.S. Cl. ..... 315/169.1; 315/169.4
(58) Field of Search ..... 315/169.3, 169.4, 315/160, 169.1, 169.2; 313/582; 345/104, 182, 60, 148, 68; G09G 3/10

(56) References Cited

U.S. PATENT DOCUMENTS 4,380,008 A * 4/1983 Kawakami et al. ..... 340/784
4,915,477 A * 4/1990 Ohta et al. ..... 345/94
5,854,540 A * 12/1998 Matsumoto et al. ..... 315/169.1
6,072,279 A * 6/2000 Shino et al. ..... 315/169.4
6,198,476 B1 * 3/2001 Hong et al. ..... 315/169.4
6,294,875 B1 * 9/2001 Kurata et al. ..... 315/169.1
6,320,560 B1 * 11/2001 Sasaki et al. ..... 315/169.1
6,414,653 B1 * 7/2002 Kobayashi ..... 345/60

FOREIGN PATENT DOCUMENTS

JP 4-315196 11/1992 ..... G09G/3/28
JP 6-175607 6/1994 ..... G09G/3/28
JP H10-10511 A 4/1998
JP 11-352924 12/1999 ..... G09G/3/28
JP 2000/20021 1/2000 ..... G09G/3/28

* cited by examiner

*Primary Examiner*—Don Wong
*Assistant Examiner*—Trinh Vo Dinh
(74) *Attorney, Agent, or Firm*—Sughrue Mion, PLLC

(57) ABSTRACT

By inserting a pre-discharge erasing voltage holding time of more than 5 microseconds after a potential change of a pre-discharge erasing pulse, and by inserting a pre-sustaining erasing period between the scanning period and the sustaining period, the residual wall charge is made constant regardless of the discharge characteristics of each cell and it becomes possible to reduce the erroneous discharge without eliminating the effective voltage distribution due to superposing the residual wall charge and the scanning voltage. By increasing the scanning pulse voltage due to the finally attained voltage of the pre-discharge erasing pulse and by superposing the wall charge corresponding to the potential difference of the finally attained voltage of the pre-discharge erasing pulse and the scanning pulse voltage, on the scanning pulse voltage, it is possible to reduce the data voltage and the scanning voltage.

7 Claims, 15 Drawing Sheets

METHOD FOR DRIVING AC PLASMA DISPLAY

BACKGROUND OF THE INVENTION

1. Field of the Invention

The present invention relates to a method for driving a so called dot matrix memory type AC plasma display panel which has shown remarkable recent progress in use for example in personal computers, office work stations, and also wall televisions etc. for which future development is expected.

2. Description of the Related Art

In general, a plasma display panel is featured by thin construction, no flicker and a large display contrast ratio. Moreover it has many features, namely that a relatively large screen is possible, response speed is fast, and a multi-color luminescence is also possible by using a spontaneous light emission type fluorescent body. Therefore, recently this is becoming widely used in the field of computer related display devices and in the field of color image displays.

For this plasma display panel, depending on the operating method thereof, there is an AC type device operated indirectly in an AC discharge state with an electrode coated with a dielectric substance, and a DC type operated in a direct discharge state with an electrode exposed to a discharge space. Furthermore for the AC type, there is a memory operating type which uses a memory of a discharge cell for a drive method, and a refresh operating type which does not use this. The luminance of the plasma display panel is proportional to the number of discharges, that is the number of repetitions of the pulse voltage. In the case of the above refresh type, if the display capacity becomes large, luminance is reduced and therefore it is mainly used in plasma display panels with small display capacity.

FIG. 1 is a cross-section showing an example of the construction of one display cell of an AC memory operating type plasma display panel. This display panel comprises two insulating boards 101 and 102 constituting a rear face and a front face, both of which are made of glass, a transparent scanning electrode 103 and a transparent sustaining electrode 104 formed on the insulating board 102, trace electrodes 105 and 106 arranged so as to lie on the scanning electrode 103 and the sustaining electrode 104 in order to lower resistance of the electrode, a data electrode 107 formed orthogonal to the scanning electrode 103 and the sustaining electrode 104, a discharge gas space 108 filled with discharge gas including helium, neon and xenon or a mixed gas thereof disposed between the insulating boards 101 and 102, a partition 109 for maintaining this discharge gas space 108 and dividing into display cells, a phosphor 111 for converting ultraviolet rays generated by discharge of the discharge gas to visible light 110, a dielectric film 112 covering the scanning electrode 103 and sustaining electrode 104, a protecting layer 113 composed of magnesium oxide or the like for protecting the dielectric film 112 against discharging, and a dielectric film 114 covering the data electrode 107.

The drive operation of a plasma display panel of such a construction, will be explained with reference to FIG. 2. Period 1 is a pre-discharge (priming) period. A pre-discharge pulse Ppr-s applied to the scanning electrode side, and a pre-discharge pulse Ppr-c applied to the sustaining electrode side are rectangular waves. In the pre-discharge period, by means of the rectangular wave of positive polarity applied to the scanning electrode, and the rectangular wave of negative polarity applied to the sustaining electrode, pre-discharge occurs in the discharge gas space near the inter-electrode gap of the scanning electrode and the sustaining electrode of all cells. Then, simultaneous with the formation of active particles which facilitate the occurrence of cell discharge, a wall charge of a negative polarity is attached to the scanning electrode, and of a positive polarity is attached to the sustaining electrode. The discharge in this case is a strong discharge form.

Period 2 is a pre-discharge erasing period. A pre-discharge erasing pulse Ppe is applied which gradually reduces the wall charge attached to the scanning electrode and the sustaining electrode in the pre-discharge period, and the waveform thereof becomes a waveform where the scanning electrode side decreases slowly with negative polarity.

Period 3 is a scanning period. Writing discharge is generated in the cell which is selected by the scanning pulse Pw of negative polarity applied to the scanning electrode and the data pulse Pdata of positive polarity applied to the data electrode, and a wall charge is attached to the cell at a location where light is emitted in the subsequent sustaining period. The writing discharge only occurs at the intersection point of the scanning electrode to which the scanning pulse Pw is applied and the data electrode to which the data pulse Pdata is applied. When discharge occurs, the wall charge is attached to that part. On the other hand, in the cell where discharge has not occurred, the wall charge is not attached.

Period 4 is a sustaining period. Starting from the sustaining electrode side, the positive polarity sustaining pulses Psus-s, Psus-c to be alternately applied to the subsequent scanning electrode side and sustaining electrode side, are applied to the scanning electrode and the sustaining electrode. At this time the wall charge is attached to the cell which is selectively written in the scanning period, and the negative polarity sustaining pulse voltage and the wall charge voltage are superposed, so that the minimum discharge voltage is exceeded and discharge occurs. The wall charge is arranged so that when this discharge occurs, the voltages applied to the respective electrodes are cancelled. Consequently, a negative charge is attached to the sustaining electrode, and a positive charge is attached to the scanning electrode. Since the next sustaining pulse is a pulse where the scanning electrode side is a negative voltage, then due to superimposing with the wall charge, the effective voltage applied to the discharge space exceeds the discharge starting voltage so that discharge occurs. Thereafter, the same situation is repeated to sustain the discharge. On the other hand, in the cell where writing discharge has not occurred the wall charge is extremely small. Therefore, even if a sustaining pulse is applied, a sustaining discharge does not occur.

In the conventional technology, the pre-discharge erasing pulse becomes a negative polarity pulse with a gradual fall. If the sum of the negative charge accumulated in the scanning electrode by the pre-discharge, and the applied voltage of the pre-discharge erasing pulse exceeds the minimum discharge starting voltage, discharge occurs. In this case, since the falling of the pulse is gradual, the discharge becomes a weak discharge form, and the wall charge is reduced to the level where the discharge starting voltage is slightly lower, and the discharge converges. Weak discharge is repeated until waveform variations of the subsequent pre-discharge erasing pulses cease.

In this discharge, even if the pulse reaches the finally attained voltage, since the discharge is intermittent for a while, the undesirable situation results where the wall charge at the pulse completion time does not become constant, so that the settable range for the subsequently applied scanning pulse and the sustaining pulse is narrow. Due to the non-uniformity of the wall charge, the required voltage distribution for the writing discharge and the sustaining discharge becomes wide, and erroneous lighting due to the erroneous discharge occurs.

SUMMARY OF THE INVENTION

It is an object of the present invention to provide a method for driving a stabilized plasma display where distribution of the erroneous discharge starting voltage is narrow, so that the erroneous discharge of the scanning period and the sustaining period is reduced.

In order to address the above problem, a first aspect of the invention is a method for driving a plasma display panel characterized in that after a potential change of a pre-discharge erasing pulse, a pre-discharge erasing voltage holding time is inserted This is so that, by providing the voltage holding time after the pre-discharge erasing pulse has gradually fallen, there is convergence of the weak discharge which continues even after the potential fluctuations of the pre-discharge erasing pulse have converged, so that erasing is possible until the residual wall charge amount becomes constant.

Moreover, a second aspect of the invention is a method for driving a plasma display panel characterized in that a scanning pulse voltage is greater than a finally attained voltage and a holding voltage of a pre-discharge erasing pulse. Since the wall charge corresponding to the potential difference of the finally attained voltage of the pre-discharge erasing pulse and the scanning pulse voltage, is superimposed on the scanning pulse voltage, it is possible to reduce the data voltage and the scanning voltage.

Furthermore, a third aspect of the invention is a method for driving a plasma display panel characterized in that a pre-sustaining erasing period is inserted between a scanning period and a sustaining period. As a result, in the case where a writing discharge does not occur in the scanning period, the residual wall charge can be erased, so that the erroneous discharge due to superposition of the residual wall charge and the sustaining voltage can be reduced.

Moreover, a fourth aspect of the invention is a method for driving a plasma display panel according to the first aspect, characterized in that the pre-discharge erasing voltage holding time is greater than 5 microseconds. This is because the time until convergence of the weak discharge which continues even after potential fluctuations of the pre-discharge erasing pulse have converged, is approximately 5 microseconds. As a result, even in the case where the discharge characteristics for each of the cells are different, the amount of wall discharge can be made constant, giving a drive method of high reliability.

Furthermore, a fifth aspect of the invention is a method for driving a plasma display panel, characterized in that a potential change in a pre-sustaining erasing voltage is gradual. As a result, the discharge of the wall charge is performed as a weak discharge, so that attachment of a charge of an opposite sign to that of the electrode after completion of discharge which occurs at the time of forced discharge, does not occur.

Moreover, a sixth aspect of the invention is a method for driving a plasma display panel characterized in that a pre-sustaining erasing voltage holding time is inserted after a potential change of the pre-sustaining erasing voltage in the pre-sustaining erasing period. As a result, since a sustaining discharge is not performed until convergence of the weak discharge which occurs in the pre-sustaining erasing voltage change, the residual wall charge can be made constant.

Furthermore, a seventh aspect of the invention is a method for driving a plasma display panel, characterized in that the pre-sustaining erasing voltage holding time is greater than 5 microseconds. This is so that the time until convergence of the weak discharge which continues even after potential fluctuations of the sustaining pre-discharge voltage have converged, is around 5 microseconds, and in order to uniformly erase the residual wall charge.

BRIEF DESCRIPTION OF THE DRAWINGS

FIGS. 5-1 to 5-8 are diagrams showing movement of charge in each period in FIG. 4.

FIG. 6 is a graph comparing erroneous lighting starting voltage distribution of the conventional example and the first embodiment.

FIG. 7 is a schema of a drive method for a plasma display in a second embodiment.

FIG. 8 is a diagram showing details of movement of charge in period 2 in FIG. 7.

FIGS. 9-1 to 9-4 are diagrams showing movement of charge in each period in FIG. 7.

FIGS. 13-1 to 13-5 are diagrams showing movement of charge in each period for the case where there is no writing discharge in the second embodiment.

FIGS. 14-1 to 14-6 are diagrams showing movement of charge in each period for the case where there is no writing discharge in the third embodiment.

DESCRIPTION OF THE PREFERRED EMBODIMENTS

First Embodiment

Figure 3:
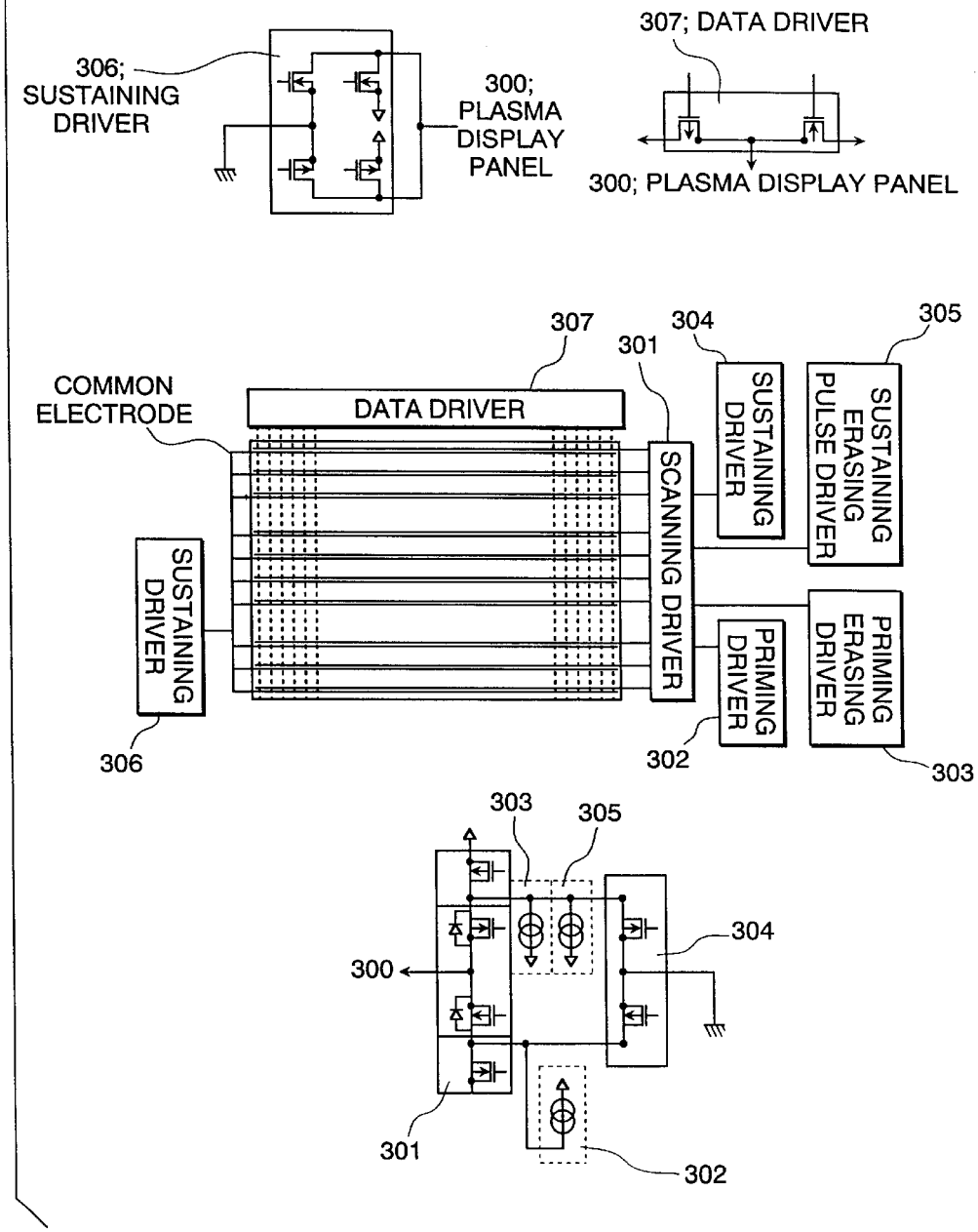
FIG. 3 is a drive circuit example for realizing a drive method of the present invention.

Hereunder is a description of a first embodiment of the present invention with reference to the drawings. FIG. 3 shows a drive circuit example for realizing a drive method according to the present invention, with a take-out portion for sustaining electrodes on a horizontal edge portion of a plasma display panel 300 and a take-out portion for data electrodes on a vertical edge portion, and the drive circuit connected to these connection portions. The drive circuit on the scanning electrode side comprises; a scanning driver 301 for outputting a scanning pulse for each of the scanning electrodes, a priming driver 302 for outputting a pre-discharge (priming) pulse made common with all of the scanning electrodes, a priming erasing driver 303 for outputting a priming erasing pulse, a sustaining driver 304 for outputting a sustaining pulse, and a sustaining erasing pulse driver 305 for outputting a sustaining erasing pulse. On the other hand, the drive circuit on the sustaining electrode side comprises a sustaining driver 306 for applying a sustaining pulse. Furthermore, a data driver 307 is connected to a data electrode.

Figure 4:
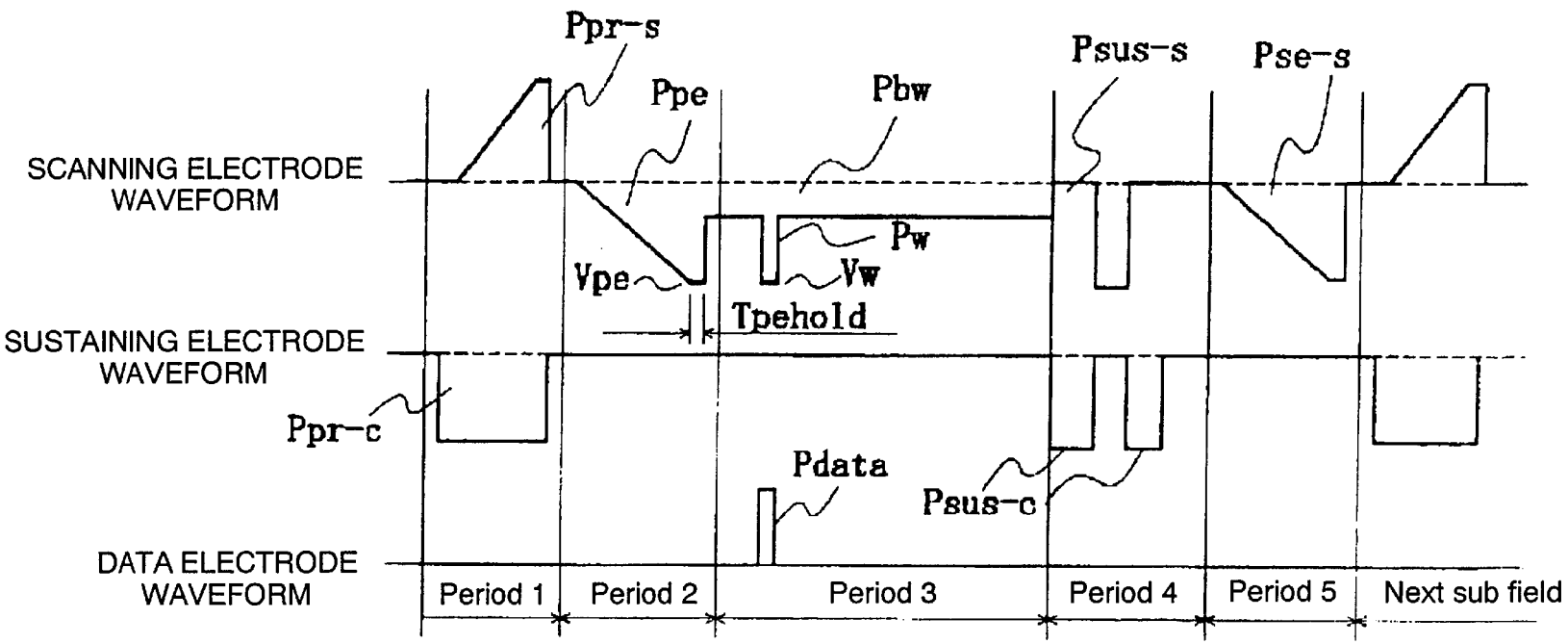
FIG. 4 is a schema of a drive method of a plasma display in a first embodiment.

In the method for driving an AC plasma display shown in FIG. 4, a first sub-field for describing gradation comprises, as with the conventional example, a pre-discharge period 1, a pre-discharge erasing period 2, a scanning period 3, a sustaining period 4 and a sustaining erasing period 5. A pre-discharge pulse applied to the scanning electrode side is a waveform of positive polarity, and a pre-discharge erasing pulse for reducing a wall charge formed on the scanning electrode and the sustaining electrode by the pre-discharge, is applied to the scanning electrode by a gradually reducing pulse of negative polarity.

In this embodiment, after the pre-discharge erasing pulse in the pre-discharge erasing period of period 2 has dropped to a pre determined voltage, a hold time (Tpehold) at that voltage is provided. This hold time is made greater than 5 microseconds.

Figure 5:
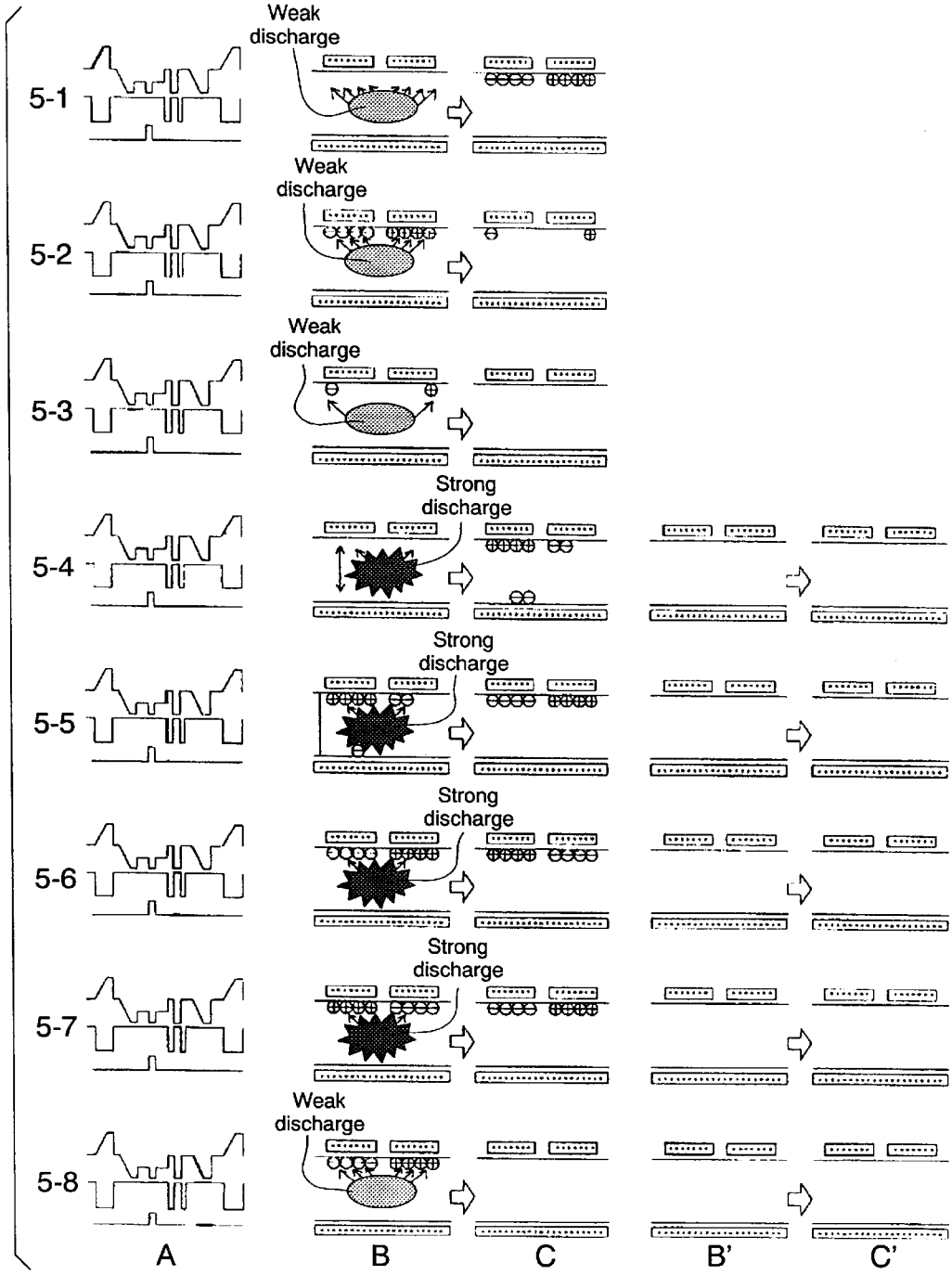

FIG. 5 schematically shows the movement of the charge in each drive period, A showing the processes during a drive waveform, B showing aspects of the generation of discharge during these processes, and C showing aspects of wall charge after discharge completion.

Figure 1:
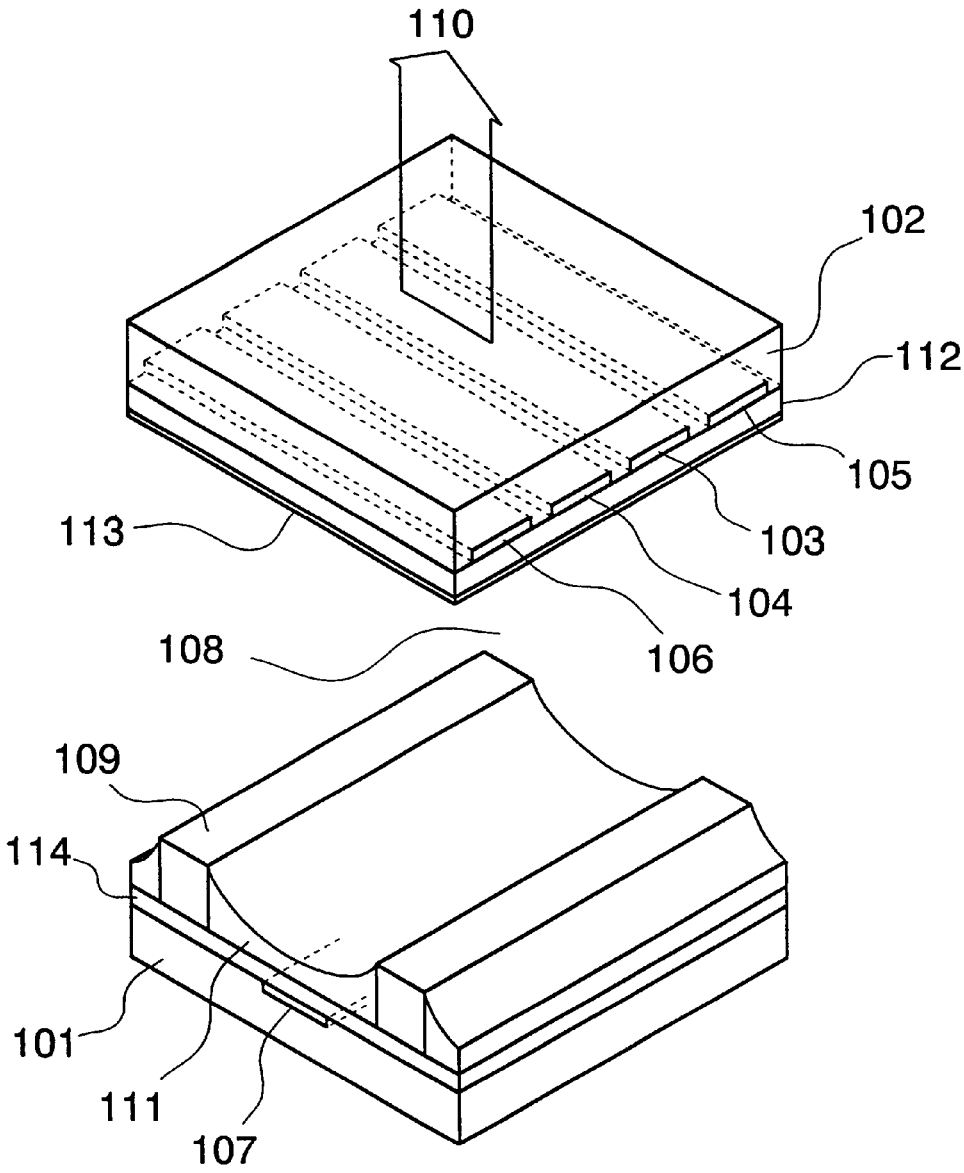
FIG. 1 is a section view showing an example of the construction of one display cell of an AC memory operation type plasma display panel.

FIG. 5-1 is the pre-discharge period. Due to the saw tooth waveform of positive polarity applied to the scanning electrode, and the rectangular waveform of negative polarity applied to the sustaining electrode, pre-discharge occurs in the discharge space near the inter-electrode gap of the scanning electrode and the sustaining electrode of all cells. Then, simultaneous with the formation of active particles which facilitate the occurrence of cell discharge, a wall charge of negative polarity is attached to the scanning electrode, and of positive polarity is attached to the sustaining electrode.

Figure 2:
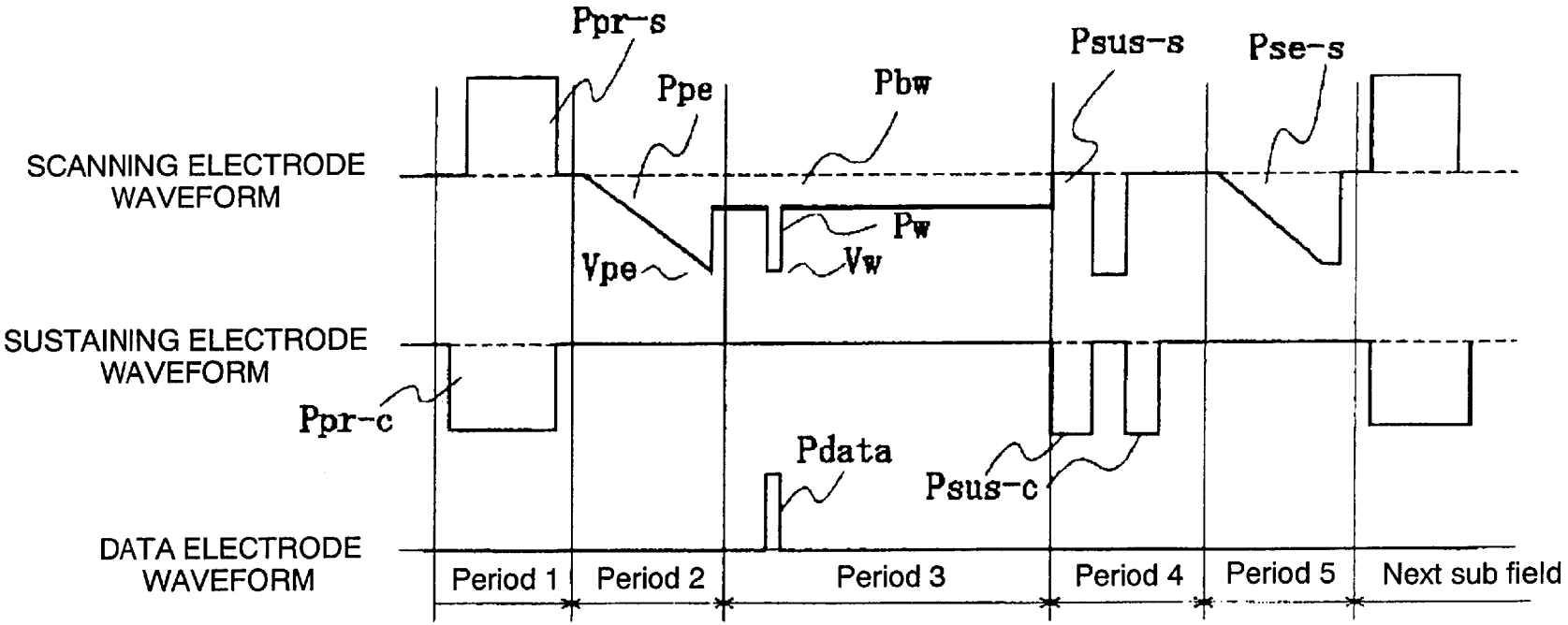
FIG. 2 is a schema of a method for driving a plasma display in a conventional example.

FIG. 5-2 is the pre-discharge erasing period. A pre-discharge erasing pulse for partially erasing the wall charge attached to the scanning electrode and the sustaining electrode in the pre-discharge period is applied, and the waveform of this becomes a sawtooth waveform with the scanning electrode side falling to negative.

In FIG. 5-3, since discharge in pre-discharge erasing continues for around 5 microseconds after the potential fluctuations of the pre-discharge erasing pulse have converged, the potential for pre-discharge erasing is held for more than 5 microseconds until this discharge converges.

FIG. 5-4 is the scanning period. Writing discharge is generated in the cell which is selected by the scanning pulse of negative polarity applied to the scanning electrode and the data pulse of positive polarity applied to the data electrode, and a wall charge is generated in a cell at a location where light is emitted in the subsequent sustaining period. The data pulse voltage is from 50 to 80V, and the scanning pulse voltage is from −170 to −190V.

The case for writing discharge is shown in FIGS. 5-4-B, C. At this time, a discharge is produced between the scanning electrode and the sustaining electrode, with the discharge produced between the scanning electrode and the data electrode as a trigger. When the discharge occurs, the wall charge of a polarity for canceling the externally applied voltage is attached to each of the electrodes when the discharge converges. Consequently, a negative charge accumulates on the data electrode and the common electrode, and a positive charge accumulates on the scanning electrode.

On the other hand, in the cell where discharge has not occurred, the state after pre-discharge erasing is held (B', C'). Further, in the overall scanning period, the scanning base pulse is applied. The potential is from −90V to −110V. This lowers the withstanding voltage of the scanning driver by reducing the amplitude of the scanning pulse, and at the same time suppresses the discharge produced by the wall charge itself formed by the writing discharge when the scanning pulse rises.

Figure 6:
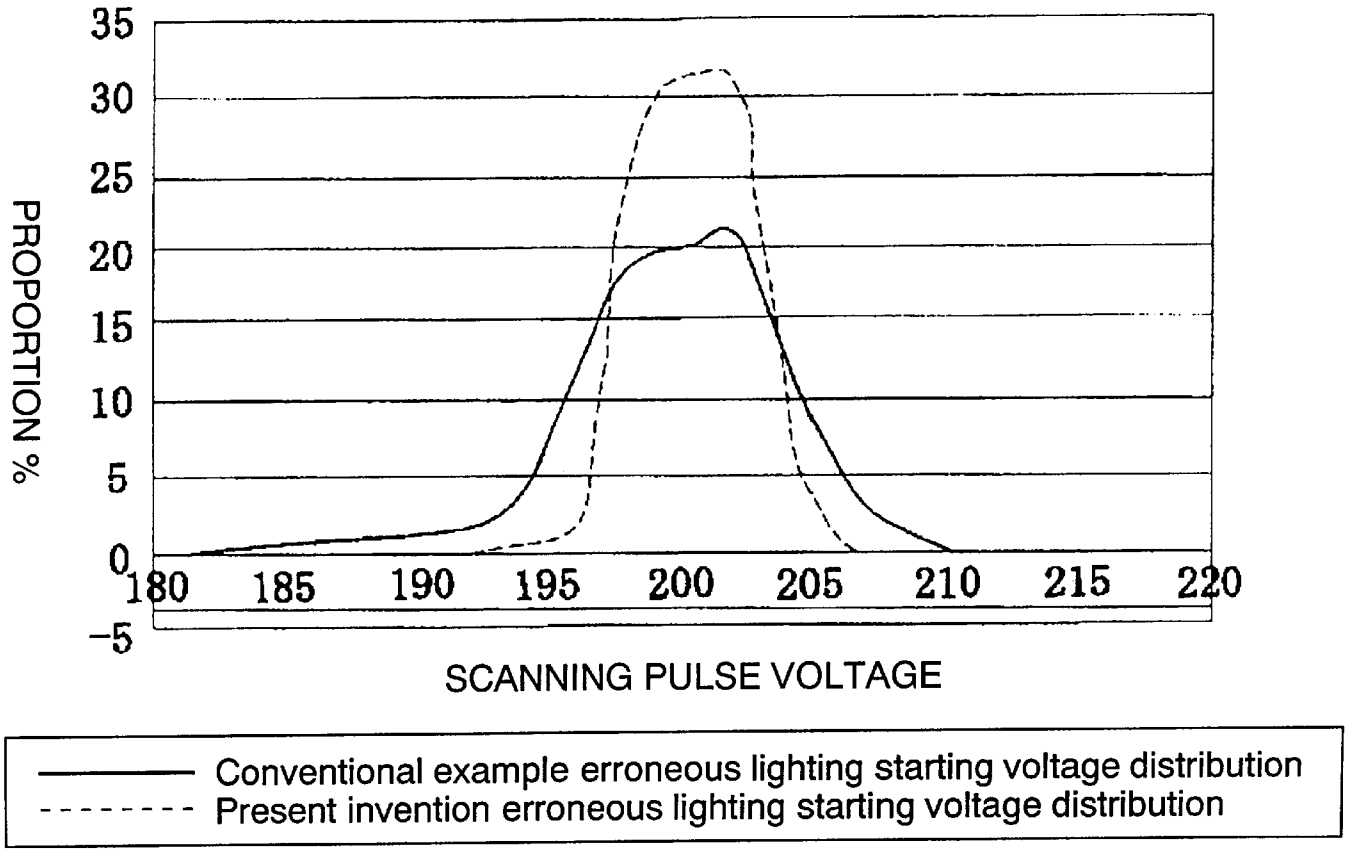
Figure 7:
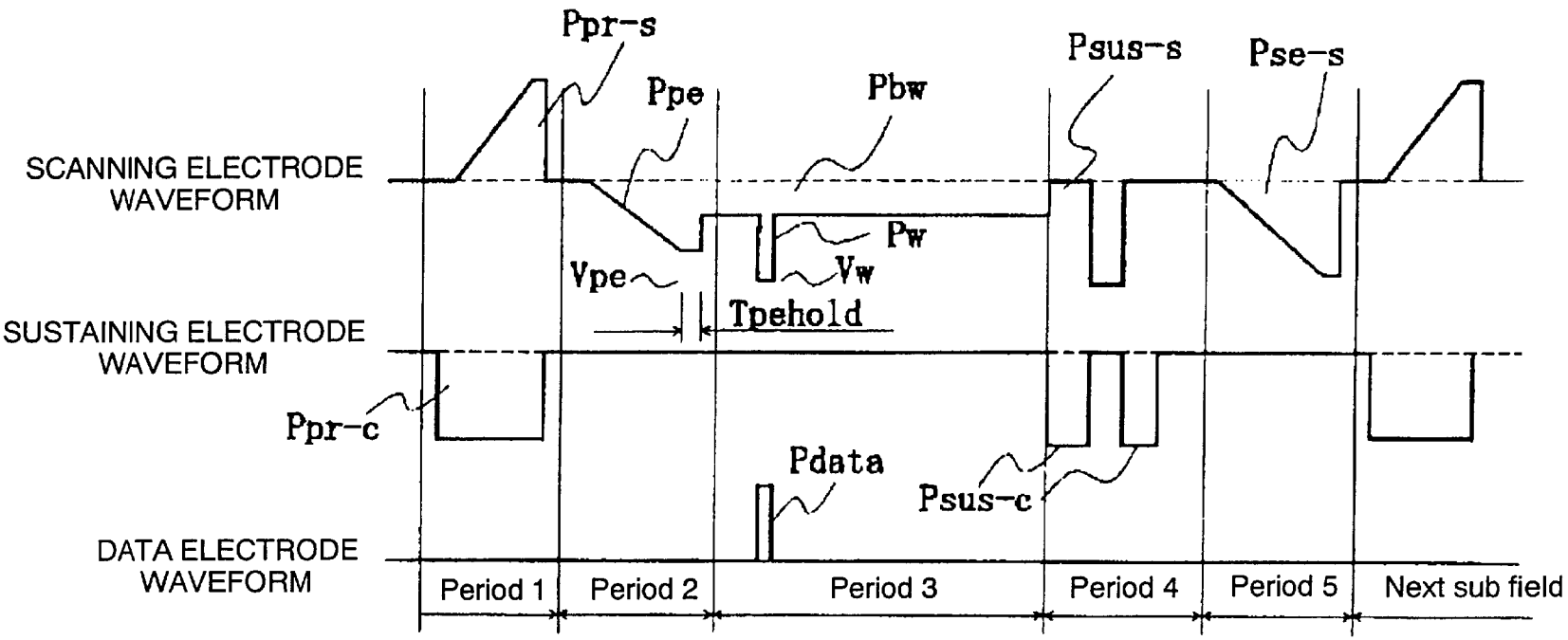

FIGS. 5-5 to 5-7 are the sustaining period. A negative polarity sustaining pulse is alternately applied to the sustaining electrode side and the scanning electrode side. At this time, the state after pre-discharge erasing is held in the cell where writing discharge has not occurred in the scanning period. Therefore, in the sustaining period, even if a sustaining pulse is applied, discharge does not occur. On the other hand, in the cell for which writing discharge has occurred so that the wall charge is selectively formed, the wall charge is attached. The sustaining pulse voltage of negative polarity and the wall charge voltage are superposed to the sustaining electrode, so that the minimum discharge voltage is exceeded and discharge occurs. The wall charge is arranged so that when discharge occurs, the voltages applied to the respective electrodes are cancelled.

FIG. 5-8 is the sustaining erasing period. In order to erase the wall charge which is arranged depending on the sustaining discharge, a saw tooth shape erasing pulse Pse-s is applied to the scanning electrode to erase the wall charge. The above 5-1 through to 5-8 constitute one sub field. This is repeated a predetermined number of times to constitute one field.

In this way, the voltage holding time after potential fluctuations of the pre-discharge erasing pulse have converged is made greater than 5 microseconds to converge the discharge. As a result even if there is a difference in the discharge characteristics for each pulse, the wall charge after the pre-discharge erasing pulse becomes constant. Since the discharge characteristics are stabilized by the subsequent writing discharge and sustaining discharge, the fluctuations of the potential necessary for writing discharge or sustaining discharge become small. Furthermore, since this enables the wall charge amount for after the pre-discharge erasing pulse to be accurately adjusted, the setting range for the data pulse or the scanning pulse voltage applied in the scanning period can be increased.

The solid line shown in FIG. 6 is the distribution of the erroneous lighting starting voltage generated in the scanning period, according to the conventional technology, while the dotted line is the distribution of the erroneous lighting starting voltage according to the present invention. The horizontal axis is the scanning pulse voltage while the vertical axis is the proportion of the panel which has an erroneous discharge, at each scanning pulse voltage. The erroneous discharge is generated when the sum of; the scanning voltage applied to the scanning electrode, the potential difference of the sustaining electrode, and the wall charge remaining after the pre-discharge erasing pulse, exceeds the discharge starting voltage. In the conventional drive waveform, the wall charge amount remaining after the pre-discharge erasing pulse is not stable. Therefore the distribution of the erroneous discharge starting voltage is wide, and it is seen that there are large fluctuations. On the other hand, in the distribution according to the drive waveform of the present invention, since the wall charge amount after pre-discharge erasing becomes constant, the distribution of the erroneous discharge starting voltage becomes narrow, showing stable characteristics.

Second Embodiment

FIG. 7 illustrates a second embodiment according to the present invention. This is characterized in that the relationship of the finally attained voltage Vpe and the holding voltage Vpe of the pre-discharge erasing pulse applied in the pre-discharge erasing period of the first embodiment, and the scanning pulse voltage Vw applied in the scanning period is always Vpe<Vw.

The pre-discharge erasing pulse is a waveform of a gentle slope. If the sum of the applied voltage and the wall charge exceeds the discharge starting voltage, then discharge starts. However since the change is gentle, the excess voltage from the discharge starting voltage is minimal. Consequently, the discharge produced is weak, and the discharge converges at a level where the discharge starting voltage drops slightly and the wall charge is reduced. This is repeated until the fluctuations in the waveform converge. Consequently, when the minimum attainable voltage of the waveform is reached, the potential difference between the scanning electrode and the sustaining electrode at that time is held at a level where the sum of the external applied voltage and the wall charge voltage goes slightly below the discharge starting voltage.

Figure 8:
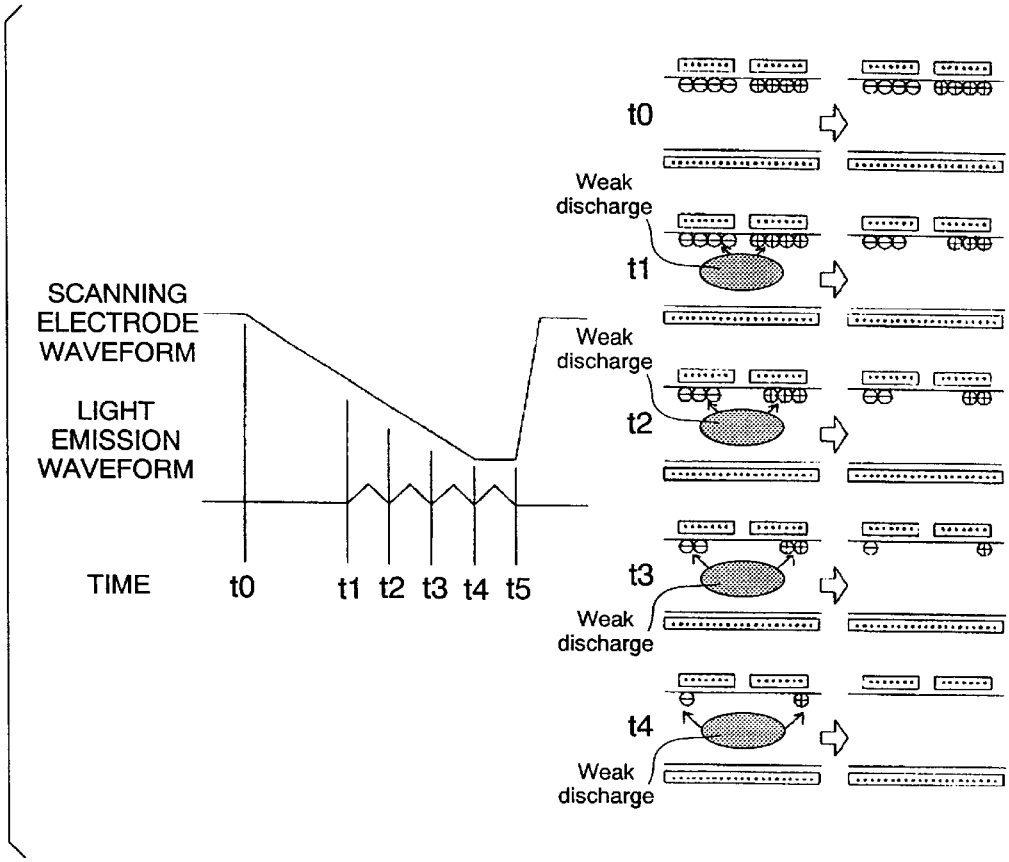

As shown in FIG. 8, time t0 is after completion of pre-discharge. A charge of negative polarity is attached to the scanning side, and of positive polarity is attached to the common side. Time t1 is when the pre-discharge erasing pulse is applied, however the sum of the voltage applied from outside and the wall charge goes below the discharge starting voltage and hence discharge does not occur. In time t2, the sum of the externally applied voltage and the wall charge goes above the discharge starting voltage, however since the excess voltage from the discharge starting voltage is minimal, discharge is weak, and at the level where the discharge starting voltage drops slightly, the wall charge is reduced and discharge converges. Thereafter, in a similar manner until t3, weak discharge repeats, and at time t4 after discharge has continued for approximately 5 microsecond after the finally attained voltage, this converges.

Figure 9:
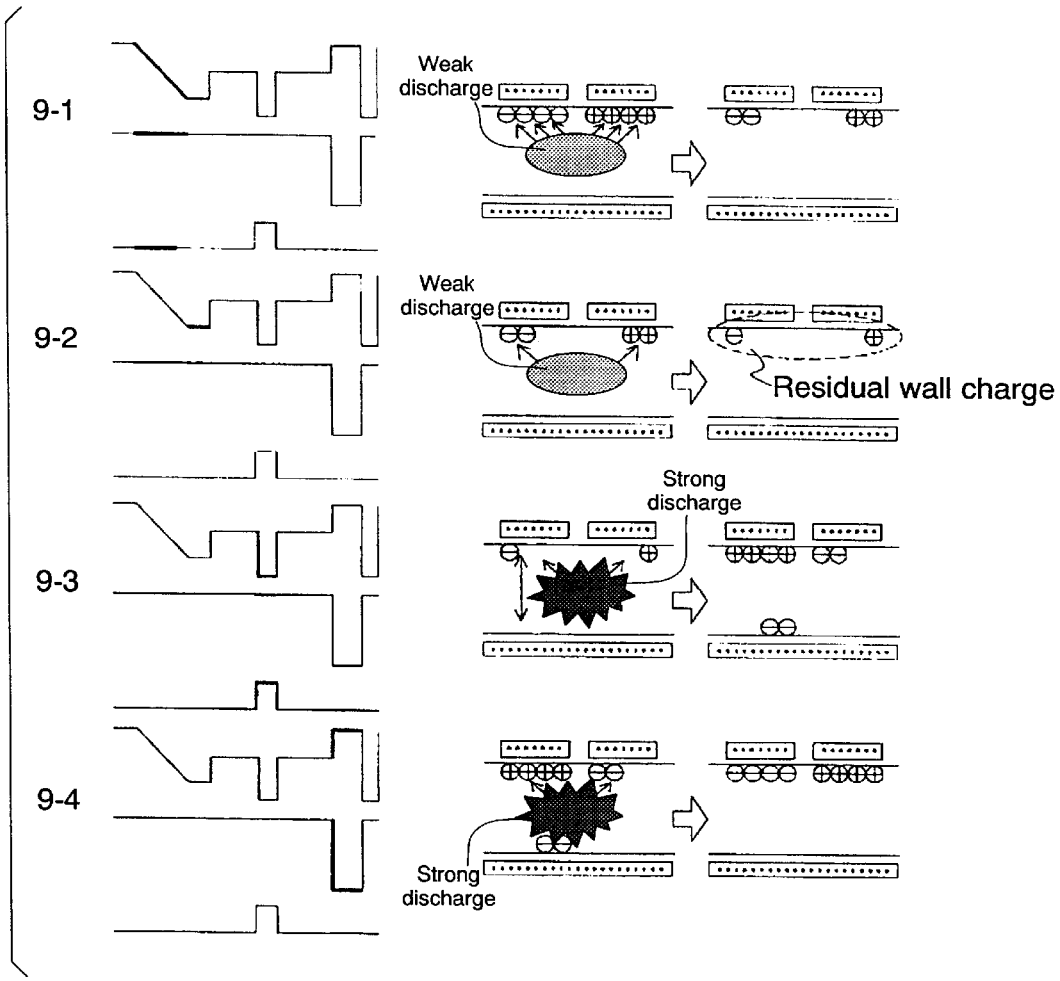

As shown in FIG. 9, since the relationship between Vpe and Vw in FIG. is a ways Vpe<Vw, a wall charge of the difference ΔVew between Vpe and Vw, is respectively arranged on the scanning electrode side and the sustaining electrode side at just Δvew/2, and superposed on the scanning pulse. Therefore, compared to the case where Vpe=Vw, the effective scanning pulse voltage Vw becomes higher. Consequently, compared to the case where Vpe=Vw, the potential difference between the scanning electrode and the data electrode can be made smaller by Δvew/2. Moreover, since the wall charge of ΔVew is attached between the surface electrodes of the scanning electrode and the sustaining electrode, the potential difference between surface electrodes can be made less by ΔVew.

Figure 10:
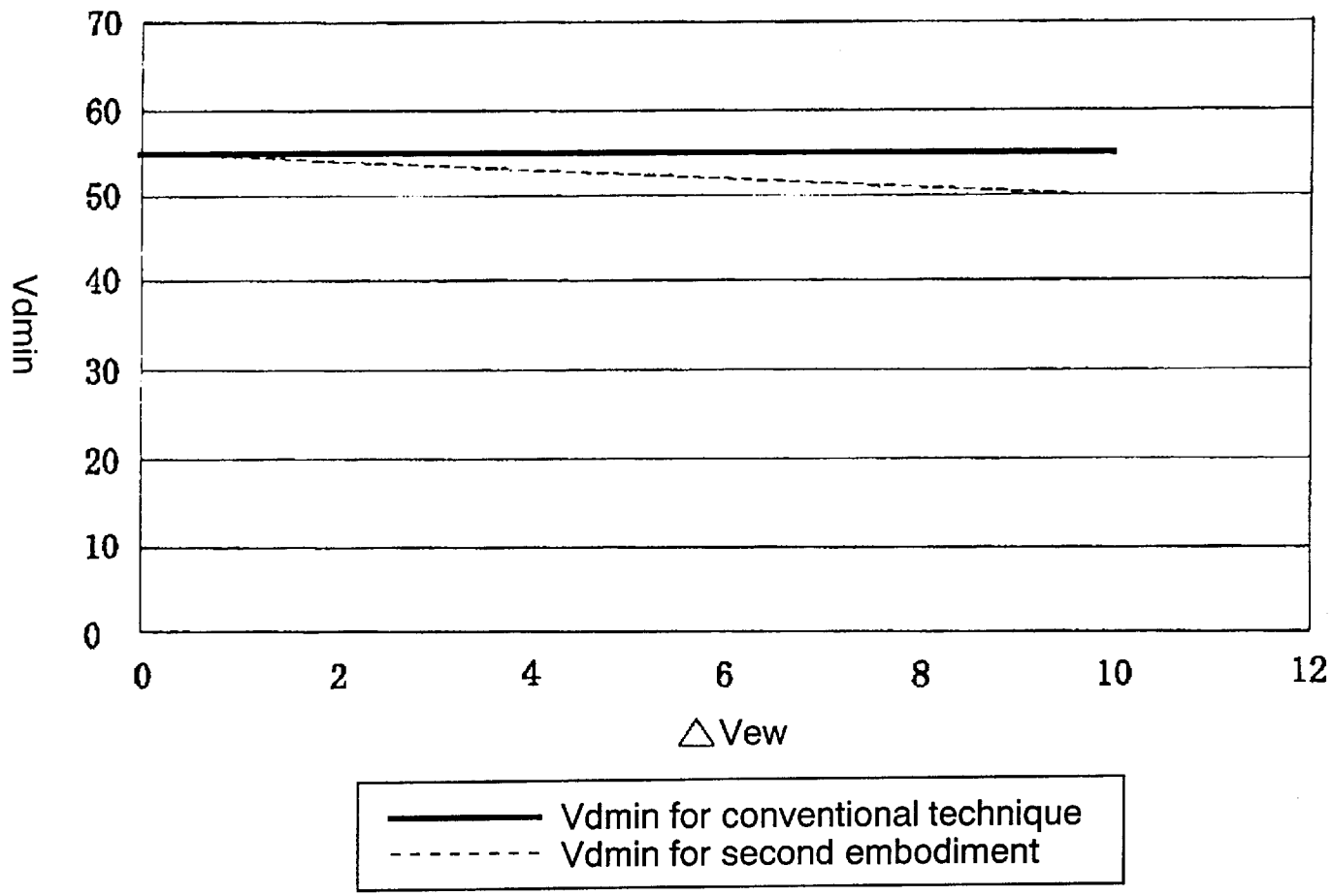
FIG. 10 is a comparison diagram of the conventional example and a second embodiment, showing a relationship between ΔVew for the case where a scanning pulse voltage Vw is constant, and a minimum data voltage Vdmin for producing writing discharge.
Figure 11:
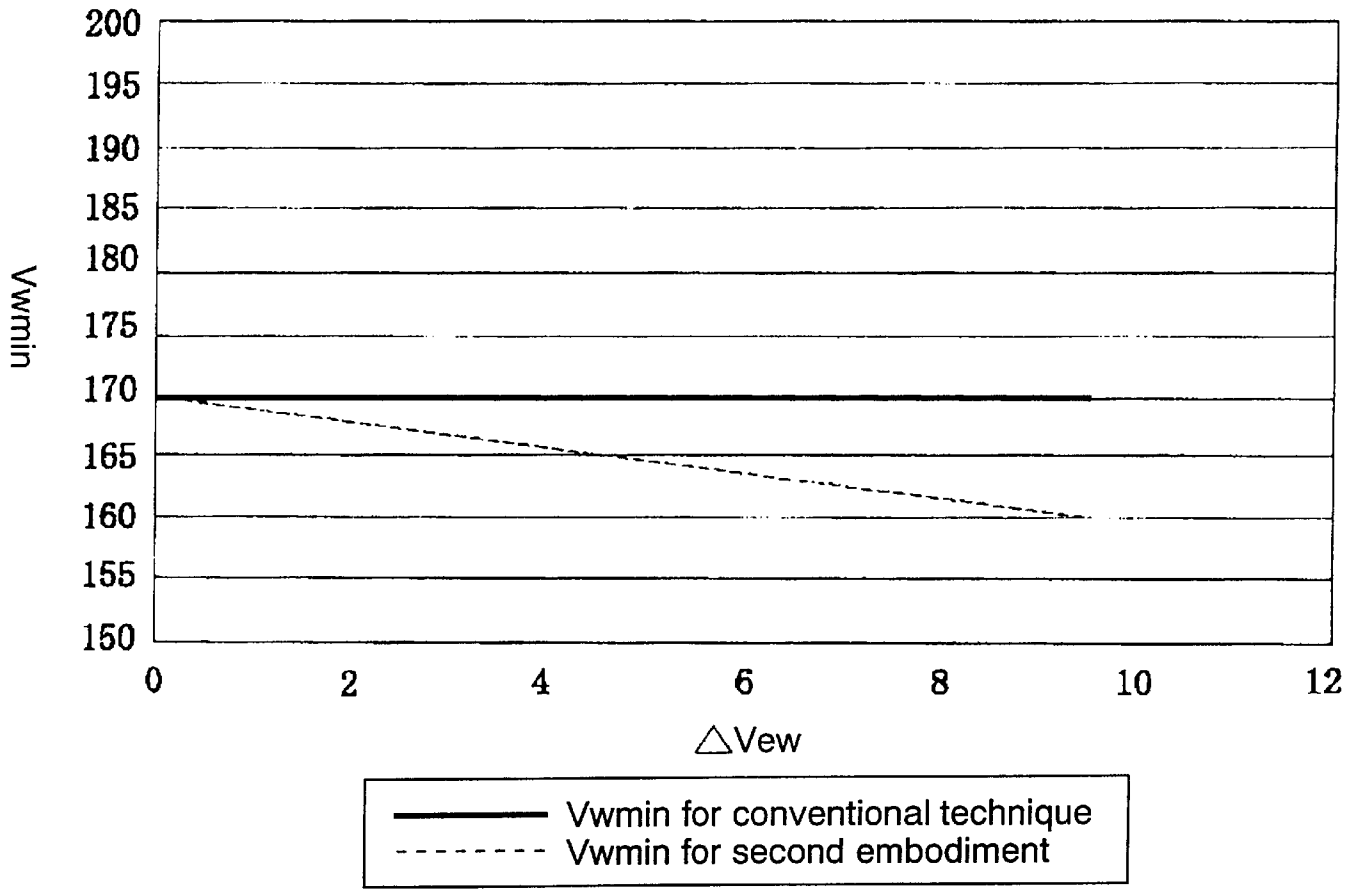
FIG. 11 is a comparison diagram of the conventional example and the second embodiment showing a relationship between ΔVew and a minimum scanning pulse voltage Vwmin for producing writing discharge.

FIG. 10 shows the relationship between ΔVew for the case where the scanning pulse voltage Vw is constant, and the minimum data voltage Vdmin for generating the writing discharge, from which is can be seen that with an increase in ΔVew, Vdmin is reduced. Furthermore, FIG. 11 shows the relationship between ΔVew and the minimum scanning pulse voltage Vwmin for generating writing discharge, from which it can be seen that with an increase in ΔVew, Vwmin is reduced. Using these characteristics, the data voltage Vd and the scanning pulse voltage Vw can be reduced.

Third Embodiment

Figure 12:
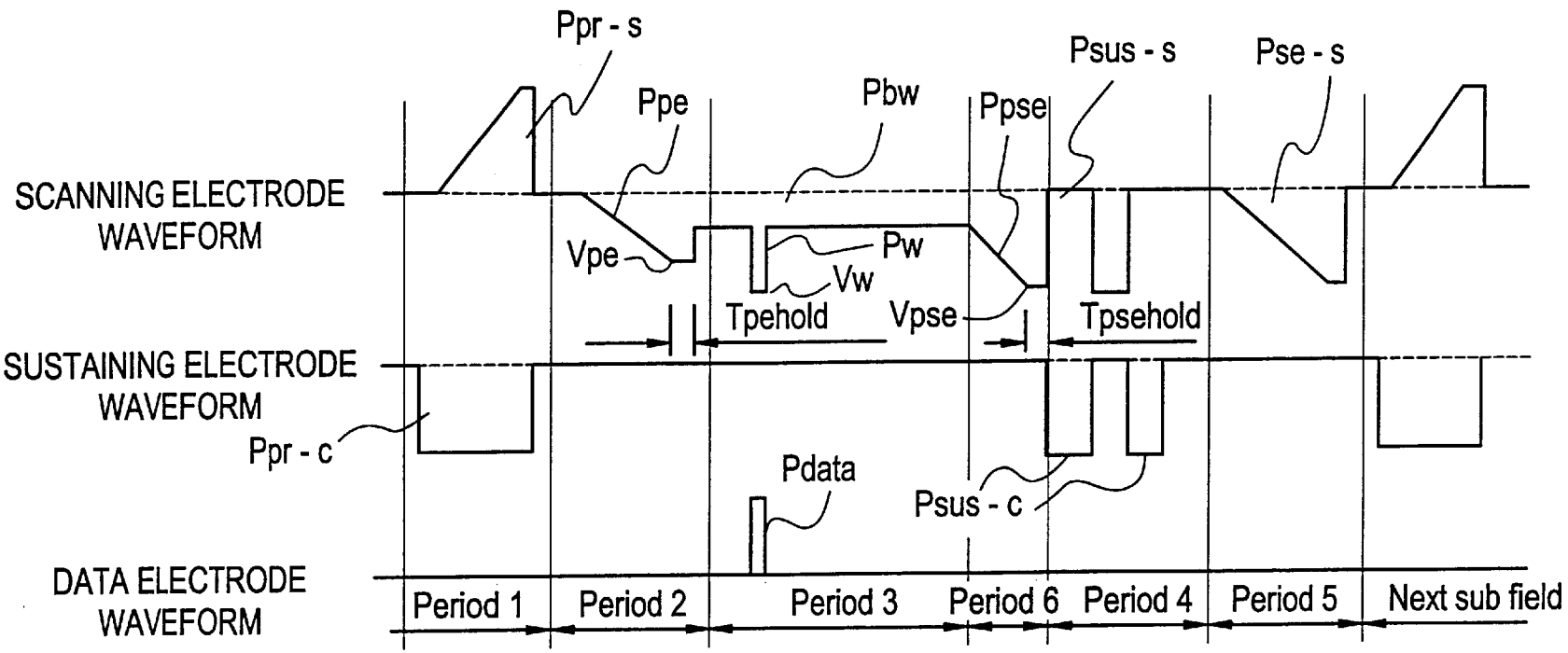
FIG. 12 is a schema of a drive method of a plasma display in a third embodiment.

FIG. 12 illustrates a third embodiment according to the present invention. This is characterized in that a pre-sustaining erasing period (period 6) is provided between the scanning period and the sustaining period of the above second embodiment, and an erasing pulse (Ppse) of a gradually falling negative polarity is applied to the scanning side. In this embodiment, after the erasing pulse of period 6 has dropped to a predetermined voltage (Vpse), a hold time (Tpsehold) at that voltage is provided.

Figure 13:
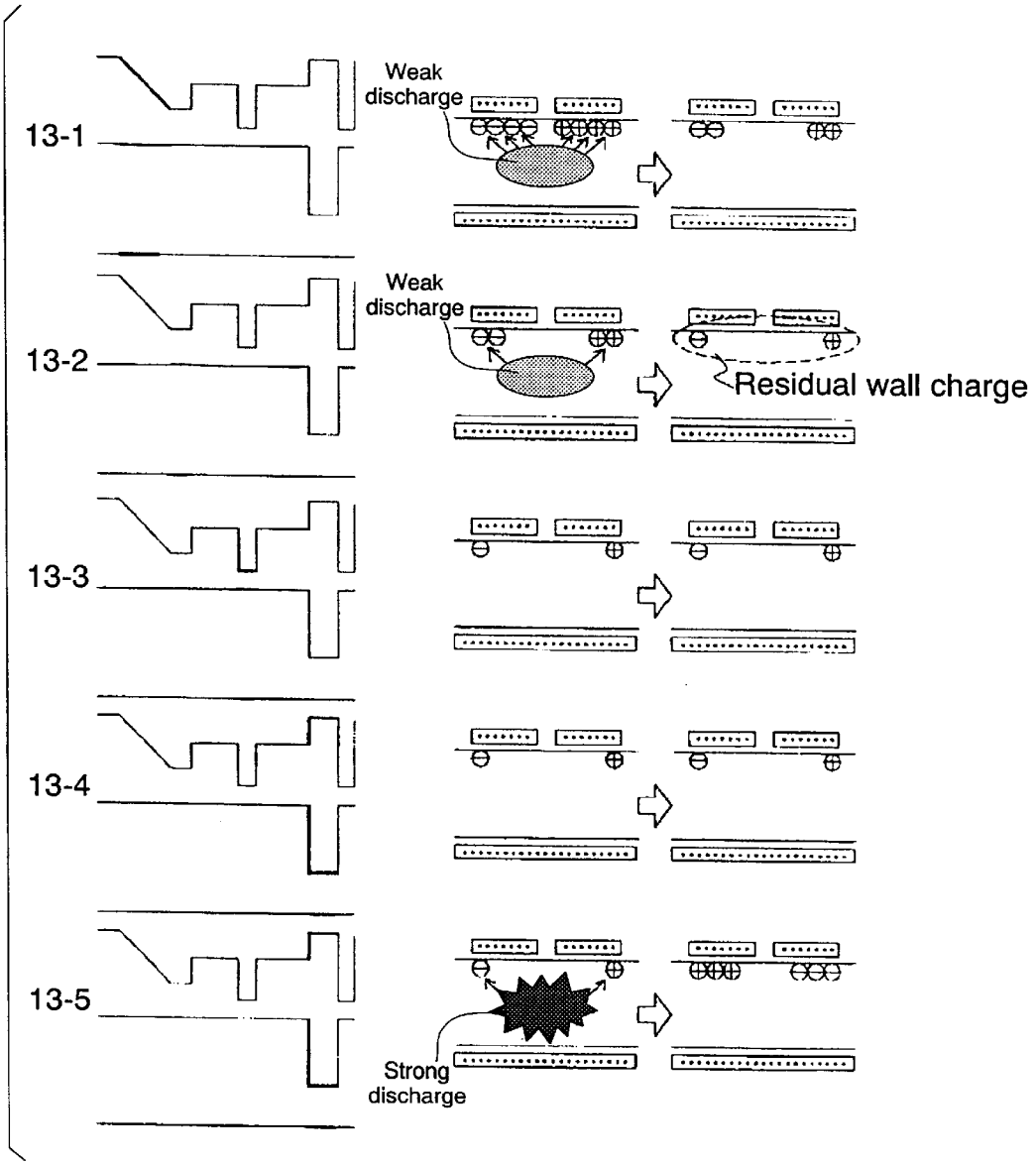

As shown in FIG. 13, in the case where in the second embodiment writing discharge is not performed in the scanning period, the wall charge remains attached to the scanning electrode and the data electrode (FIG. 13-2). Consequently, when in this condition the sustaining period is entered, the sustaining pulse and the remaining wall charge are superposed so that an erroneous discharge occurs (FIG. 13-5). There is thus the undesirable situation where the settable range of the sustaining voltage becomes narrow.

In order to improve on this, the pre-sustaining erasing period is provided between the scanning period and the sustaining period, and by applying a scanning pre-erasing pulse of a gradually reducing negative polarity to the scanning electrode, the wall charge remaining on the scanning electrode and the sustaining electrode can be erased, and the settable range for the sustaining voltage can be increased.

Figure 14:
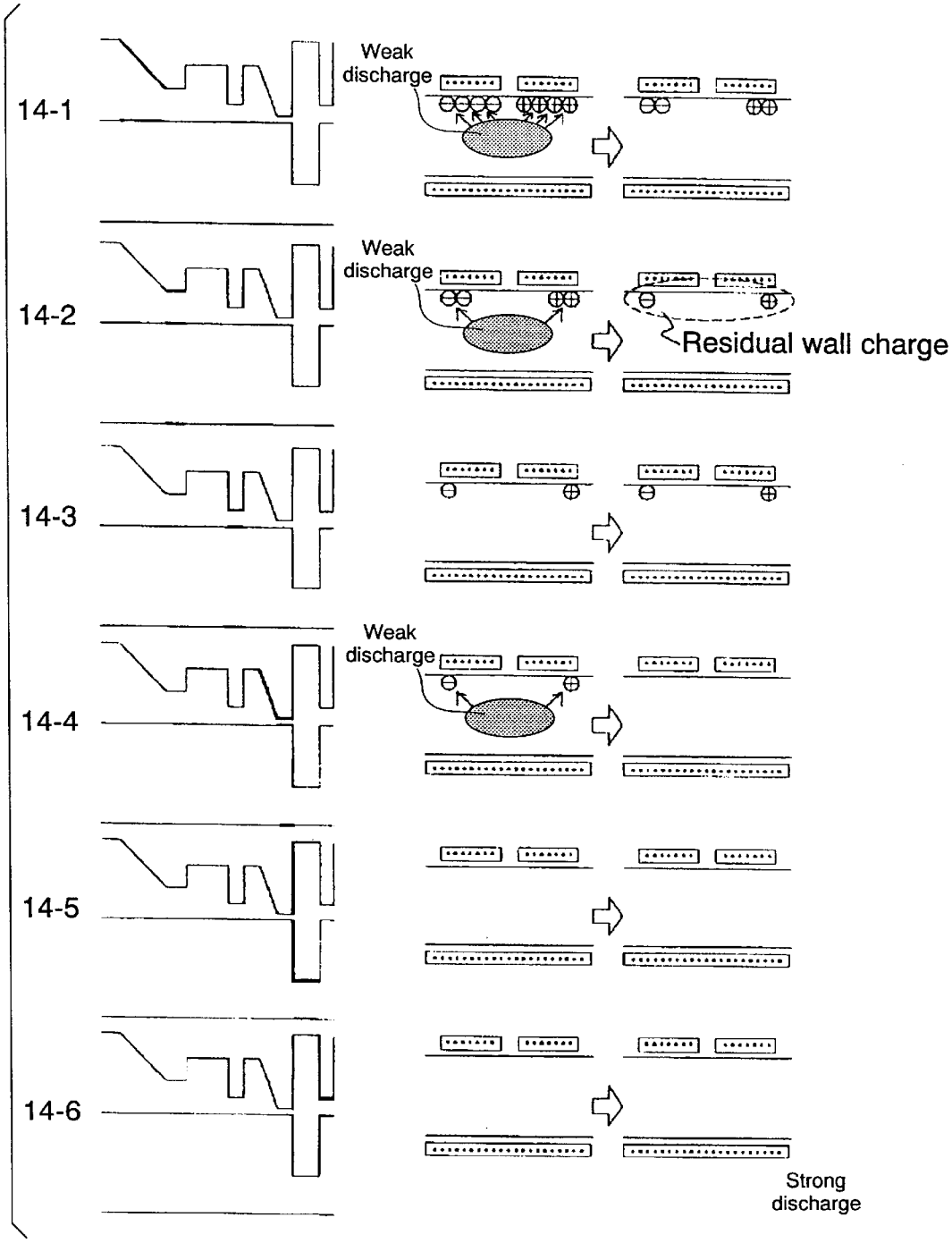

FIG. 14 describes each period for the case where writing discharge is not performed in the third embodiment. In FIG. 14-2, since the finally attained voltage of the applied pre-discharge erasing pulse is lower than the scanning pulse voltage, the wall charge of ΔVew/2 remains on the scanning electrode and the sustaining electrode. In the case where writing discharge does not occur (FIG. 14-3), a negative charge remains on the scanning electrode and a positive charge remains on the sustaining electrode. In FIG. 14-4, a gradually reducing pre-sustaining erasing pulse of negative polarity is applied to the scanning side. However, in the case where writing discharge occurs, a positive charge remains on the scanning electrode and a negative charge remains on the sustaining electrode. Therefore a charge in a direction to cancel the voltage of the pre-sustaining erasing pulse is not produced. On the other hand, in the case where writing discharge has not occurred, the negative charge remaining on the scanning electrode and the positive charge remaining on the sustaining electrode are superposed on the pre-sustaining erasing pulse, so that discharge occurs. Since at this time the pulse being applied is gradual, then as with the pre-discharge erasing pulse, the discharge becomes a weak discharge form, and discharge continues for around 5 microseconds after the finally attained voltage. Consequently, the applied voltage of the pre-sustaining erasing pulse is commensurate with the discharge starting voltage, and by inserting a pre-sustaining erasing period of more than 5 microseconds, the wall charge remaining on the scanning electrode and the sustaining electrode can be erased. Therefore, the voltage settable range in the next sustaining period can be increased.

Figure 15:
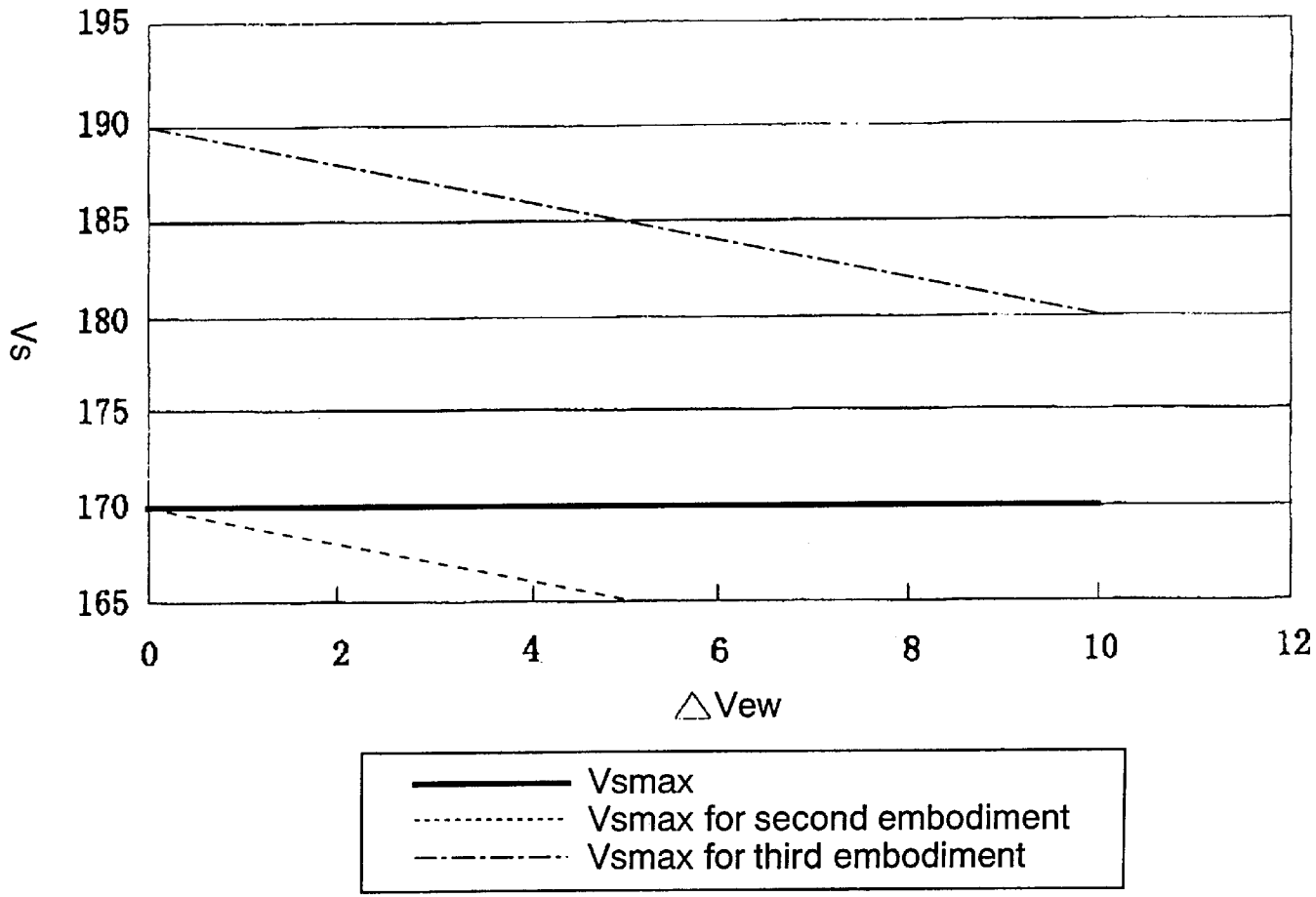
FIG. 15 is a diagram showing a relationship between ΔVew and a settable range of a sustaining voltage.

FIG. 15 shows the relationship between ΔVew and a settable range for the sustaining voltage. The horizontal axis of the graph is the potential difference ΔVew between the pre-discharge erasing pulse voltage and the scanning pulse voltage, while the vertical axis is the sustaining voltage. The settable range for the sustaining voltage is stipulated by a minimum sustaining voltage Vsmin for sustaining the sustaining discharge, and a minimum sustaining voltage Vsmax for starting the erroneous discharge. Vsmin shows a constant value regardless of ΔVew. On the other hand, Vsmax for the case where the pre-sustaining erasing pulse is not applied falls as ΔVew increases, so that the settable range for the sustaining voltage is reduced. On the other hand, Vsmax for the case where the pre-sustaining erasing pulse is applied shows a constant value regardless of ΔVew, and the settable range for the sustaining voltage is wider compared to the case for where the pre-sustaining erasing pulse is not applied.

According to the invention of the first through seventh aspects of the invention, in the method for driving an AC plasma display, by inserting the pre-discharge erasing voltage holding time, the residual wall charge can be made constant regardless of the discharge characteristics of each cell. Therefore it is possible to reduce the erroneous discharge of the scanning period. Furthermore by making the finally attained voltage of the pre-discharge erasing pulse smaller than the scanning voltage, then from the effect of superposing the wall charge and the scanning voltage, the data voltage and the scanning pulse voltage can be reduced. Moreover, by inserting the pre-sustaining erasing period, the residual wall charge in the case where there is no writing discharge can be erased so that the erroneous discharge can be further developed. By means of these drive methods, the reliability of driving a plasma display can be increased.

What is claimed is:

1. A method for driving a dot matrix type AC plasma display panel having a memory function comprising:

first, changing a potential of a pre-discharge erasing pulse and then, inserting a pre-discharge erasing voltage holding time wherein said pre-discharge erasing pulse is a pulse that reduces the wall charge of a scanning electrode and a sustaining electrode and said pre-discharge erasing voltage holding time is a period time, after the potential of said pre-discharge erasing pulse is changed, during which the voltage of said pre-discharge erasing pulse is held.

2. A method for driving a dot matrix type AC plasma display panel according to claim 1, comprising:

applying a pre-discharge erasing pulse and a scanning pulse wherein a voltage of the scanning pulse is greater than a finally attained voltage of said pre-discharge erasing pulse and a holding voltage of the pre-discharge erasing pulse and said finally attained voltage is the final voltage the pre-discharge erasing pulse attains after the potential of said pre-discharge erasing pulse is changed.

3. The method for driving a plasma display panel according to claim 1, wherein said pre-discharge erasing voltage holding time is greater than 5 microseconds.

4. A method for driving a dot matrix type AC plasma display panel having a memory function comprising:

in a subfield applying a scanning pulse in a scanning period and applying a sustaining pulse in a sustaining period and inserting a pre-sustaining erasing period between said scanning period and said sustaining period in said subfield wherein said pre-sustaining erasing period is a period of time during which a pulse is applied to a scanning electrode that erases wall charges on said scanning electrode.

5. The method for driving a plasma display panel, according to claim 4, wherein a potential change in a pre-sustaining erasing voltage in said pre-sustaining erasing period is gradual wherein said pre-sustaining erasing voltage is a voltage applied to the scanning electrode that erases wall charges on said scanning electrode.

6. The method for driving a plasma display panel according to either one of claim 4 or 5, wherein a pre-sustaining erasing voltage holding time is inserted after a potential change of the pre-sustaining erasing voltage in said pre-sustaining erasing period and said pre-sustaining erasing voltage holding time is a period time after the potential of said pre-sustaining erasing voltage is changed, during which the voltage of said pre-sustaining erasing voltage is held.

7. The method for driving a plasma display panel according to claim 6, wherein said pre-sustaining erasing voltage holding time is greater than 5 microseconds.

* * * * *